United States Patent [19]

Barr et al.

[11] Patent Number: 4,669,556

[45] Date of Patent: Jun. 2, 1987

[54] DRILL BIT AND CUTTER THEREFOR

[75] Inventors: John D. Barr, Cheltenham; Terry R. Matthias, Gloucester, both of United Kingdom; Malcolm R. Taylor, Houston, Tex.

[73] Assignee: NL Industries, Inc., New York, N.Y.

[21] Appl. No.: 693,848

[22] Filed: Jan. 25, 1985

Related U.S. Application Data

[63] Continuation-in-part of Ser. No. 575,556, Jan. 31, 1984, Pat. No. 4,570,725.

[51] Int. Cl.[4] ..... E21B 10/46

[52] U.S. Cl. ..... 175/329; 175/410

[58] Field of Search ..... 175/410, 412, 329; 76/108 A, 101 E; 407/42, 61, 62, 63

[56] References Cited

U.S. PATENT DOCUMENTS

| | | | |
|---|---|---|---|
| 3,106,973 | 10/1963 | Christensen | 175/410 X |
| 3,726,351 | 4/1973 | Williams, Jr. | 76/108 A X |
| 3,999,619 | 12/1976 | Watson | 175/410 X |
| 4,128,136 | 12/1978 | Generoux | 175/410 X |
| 4,333,540 | 6/1982 | Daniels et al. | 175/410 X |
| 4,382,477 | 5/1983 | Barr | 175/410 |
| 4,451,093 | 5/1984 | Perez | 175/410 X |
| 4,491,188 | 1/1985 | Grappendorf | 175/329 |
| 4,498,549 | 2/1985 | Jurgens | 175/329 |
| 4,533,004 | 8/1985 | Ecer | 175/329 |

*Primary Examiner*—Stephen J. Novosad
*Assistant Examiner*—David J. Bagnell
*Attorney, Agent, or Firm*—Browning, Bushman, Zamecki & Anderson

[57] ABSTRACT

An elongate cutter for a drag-type drill bit includes a stud defining one end thereof and a cutting formation comprising a cutting face generally adjacent the other end. Length extends from one end to the other, depth extends generally transverse to the cutting face as well as transverse to the length, and width extends transverse to both length and depth. The stud has a cross section transverse to its length such that the cross section cannot be circumscribed by a reference circle whose diameter is equal to the maximum width of the cross section. The cross section also has an assumed section modulus, in the direction of depth, greater than that of the reference circle. The leading side of the cutter comprises a first planar zone adjacent the one end and a second planar zone adjacent the other end, and on which the cutting formation is carried. The maximum lateral dimension of the leading side is generally greater than or equal to the maximum width of the cutter.

21 Claims, 17 Drawing Figures

FIG. 4
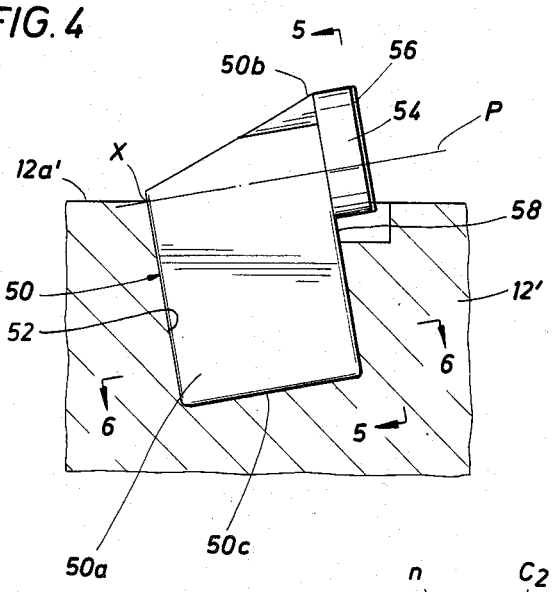
FIG. 5
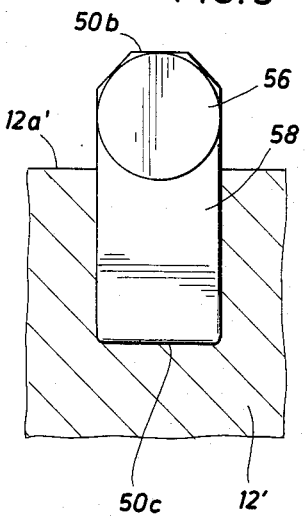
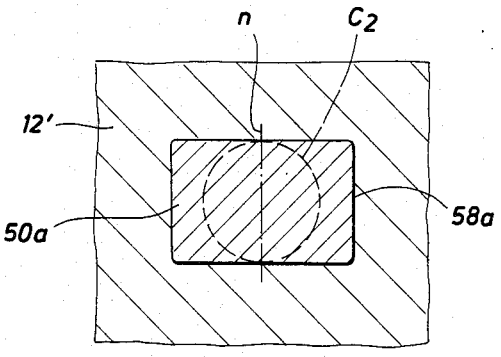
FIG. 6
FIG. 7
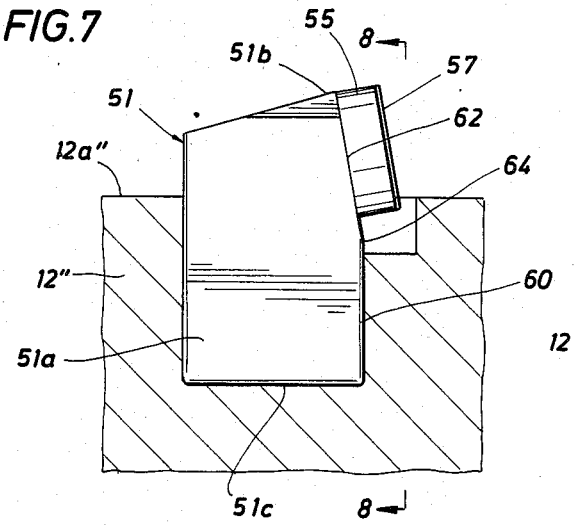
FIG. 8
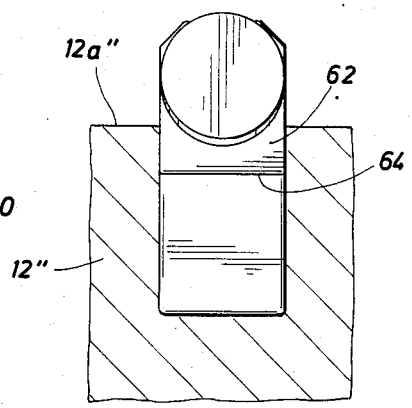

DRILL BIT AND CUTTER THEREFOR

CROSS REFERENCE TO RELATED APPLICATION

This is a continuation-in-part application of co-pending U.S. patent application Ser. No. 575,556 filed Jan. 31, 1984, now U.S. Pat. No. 4,570,725.

BACKGROUND OF THE INVENTION

The present invention pertains to drill bits, more specifically to drag-type drill bits and to the cutter devices or cutters which are mounted on the bodies of such bits. The bits may be of the full bore or corehead type.

A typical bit includes an integral bit body, typically comprised of one or more body members of either tungsten carbide matrix material or a suitable metal, relatively non-frangible as compared to tungsten carbide, e.g. steel. A plurality of cutter devices is mounted on the bit body. Each such cutter device typically has a stud portion, which is mounted in a pocket or recess in a bit body member and defines one end of the device, and a cutting formation generally adjacent the other end.

The cutting formation is located on what may be considered a leading side of the device, so that as the bit is rotated in its intended direction in use, this cutting formation engages and drills the earth formation. The opposite side of the device is considered the trailing side, and the device may further be considered to have a pair of lateral sides, generally opposite each other, and interconnecting the leading and trailing sides. The leading side may also be referred to as the forward side, and the trailing side referred to as the rear side.

In use, tremendous forces are exerted on the cutting devices in the forward-to-rear direction. In some cases, cutting devices have been broken by these forces.

Accordingly, it is desirable to maximize the strength of these devices. However, this goal must be balanced and coordinated with other objectives and/or limitations.

For example, the design of the bit body necessarily places limits on the maximum transverse dimensions of the stud portion of the device, in both the forward-to-rear and lateral directions. Furthermore, the devices are often arranged in rows extending generally radially across the working end face of the bit body, and the performance of the bit is affected by the number of devices which may be placed in a row, or in other words, the spacing of the cutting formations of the devices in a given row. In general, at least for some types of earth formations, it is desirable to place these cutting formations as close together as possible, i.e. to place as many devices as possible in a given row on the bit body. However, a limiting factor on this objective may be that there be adequate thickness of bit body material left between each two adjacent cutter devices.

Another important consideration is that it should be possible to manufacture a number of such cutter devices to fairly accurate dimensions, i.e. within fairly close tolerances, but without undue expense in the manufacturing process.

In the past, the stud portions of typical cutter devices have been generally cylindrical, except for a small groove or keyway on the rear or trailing side, which may cooperate with a small protrusion in the respective pocket of the bit body to properly index or orient the cutter device with respect to the bit body.

Such cylindrical stud portions have not satisfied the above-mentioned goals or objectives to the extent desirable. If the diameter of such a cylindrical stud portion were chosen to correspond to the maximum forward-to-rear dimension considered practical for a given bit design, it would be necessary either to leave less than optimum amounts of bit body material between the pockets for adjacent cutter devices, or to space such adjacent pockets and cutter devices apart by an amount greater than that which would permit the desired number of cutter devices per row on the bit body. On the other hand, if a smaller diameter were chosen, so that more cutter devices could be used in a row without unduly thinning or weakening the portions of the bit body between adjacent cutter devices, the devices may not be strong enough in the forward-to-rear direction, and may break off in use, as described above.

Another potential problem with such conventional cylindrical stud portions is that the aforementioned keyway could represent a weakening concavity in the cross section.

Yet a further problem with conventional cutter mounting bodies having cylindrical stud portions relates to the form of the cutting formation and its manner of mounting on the mounting body. The cutting formation per se may comprise a relatively thin layer of superhard material. Although polycrystalline diamond is by far the most common such material, others might be feasible. For purposes of this specification, "superhard" will refer to materials significantly harder than silicon carbide, which has a Knoop hardness of 2470. For convenience, this thin layer of superhard material is usually first applied to one side of a circular disc, e.g. of sintered tungsten carbide, which serves as a carrier for the thin layer of polycrystalline diamond or the like. Then, the opposite side of this carrier disc is bonded to the mounting body.

As previously mentioned, the mounting body includes the aforementioned stud portion adjacent one end, and when this stud portion is installed in its respective pocket in the bit body, the other end of the mounting body will protrude outwardly from the bit body. It is to the leading side of the mounting body adjacent this other end that the carrier disc must be bonded. Thus, it is not feasible for the mounting site on the mounting body to be cylindrical because of the difficulty of forming the adjacent side of the carrier disc with a matching concave cylindrical surface.

Accordingly, it has become conventional to begin with a cylindrical workpiece for the mounting body and then grind a planar surface on the leading side of the cylindrical member to which a flat-sided carrier can readily be bonded. This planar mounting surface or flat is disposed at an angle with respect to the centerline of the cylindrical workpiece, which also builds in a back rake angle to the cutting face.

This leads to several problems. First, in order for the mounting flat to be wide enough to receive a carrier disc of a desired diameter, the cylindrical workpiece on which such flat is machined, and which defines the stud diameter, must have an even greater diameter. Furthermore, the mounting flat will necessarily intersect the cylindrical portion of the mounting body in an elliptical line, which has proven to be extremely troublesome in actual practice for several reasons.

SUMMARY OF THE INVENTION

The present invention provides an improved cutter device, and more specifically, improvements in the configuration of the mounting body of such a device, which, while fairly easy and inexpensive to manufacture within fairly close tolerances, provides a better balancing or optimization of the above goals and objectives, which have previously been somewhat at odds with one another as explained.

In particular, a first form of cutter device according to the present invention has a stud portion defining one end thereof and a cutting formation generally adjacent the other end. The stud portion may be defined by a mounting body of hard material, e.g. sintered tungsten carbide, and the cutting formation may be defined by a layer of superhard material, e.g. polycrystalline diamond, carried on the mounting body, either directly or via an intermediate carrier member. However, at least some aspects of the invention are likewise applicable to cutter devices having either fewer or more parts, e.g. to a device which might be a single, monolithic body.

In any event, the stud portion of the device has external side walls which, through a major part of the length of the stud portion and in transverse cross section, define a circle interrupted by at least one section of greater radius of curvature. Preferably, this transverse cross-sectional configuration includes a plurality of circumferentially spaced, concentric arcs of said circle, and a plurality of connector sections interconnecting said arcs and of greater radius of curvature.

More specifically, there is preferably at least one diametrically opposed pair of such arcs, and at least one diametrically opposed pair of such connector sections, with the transverse dimension of the stud portion between said arcs being greater than the transverse dimension of the stud portion between the connector sections. The arcs are preferably located on the forward and rear sides of the device, with the connector sections on the lateral sides. Preferably, the connector sections are flat, i.e. of infinite radius of curvature, although they could be slightly concave, or alternatively, could be convex, but with a greater radius than the forward and rear arcs.

The reduction in thickness between the lateral sides permits optimum use of the maximum possible forward-to-rear dimension, while also permitting the devices in a given row on a bit body to be spaced fairly close together, i.e. for a relatively large number of devices to be provided on each row, yet without undue thinness and consequent weakness of the sections of bit body material located between adjacent stud portions, particularly where the lateral sides, generally defined by the connector sections, are relatively flat.

At the same time, this cross-sectional configuration, which is not circular, but which nevertheless is not unduly complicated, permits the elimination of grooves or keyways for indexing the stud portions with respect to the bit body, and thus eliminates a further potential weak point in the stud portion.

Furthermore, a stud portion of this improved form is particularly susceptible to manufacture by a process which, while simple and relatively inexpensive, nevertheless allows mass production to fairly close tolerances. Specifically, a workpiece body may first be formed with a cylindrical stud portion by any more or less conventional technique, e.g. powder metallurgy type molding processes. Then, the diametrically opposed lateral sides of such cylindrical stud portion are machined to reduce the transverse dimension of the stud portion therebetween and provide the aforementioned connector sections, preferably flats.

A cutter device having a stud portion of this first form is actually stronger in the front to rear direction than a circular stud whose diameter is equal to the width (or maximum width, if the width varies) of the improved stud. In fact, this first form of cutter device represents a special case or example of certain aspects of the present invention whereby the relative strength of the device may be improved.

A number of different non-circular cross-sectional forms, including the first form described hereinabove, will accomplish this purpose. In accord with one very broad aspect of the present invention, it may be said that a common characteristic of these various forms is that their stud portions each have a transverse cross section such that it cannot be circumscribed by a reference circle whose diameter is equal to the maximum width of the cross section.

More specifically, improved strength can be assured if the stud portion of the device has a transverse cross section having a parameter which will be referred to herein as "assumed section modulus," taken in the direction of depth, which is greater than that of the aforementioned reference circle. The concept of assumed section modulus will be explained hereinafter.

When the cross section has such an assumed section modulus, its forward or leading edge may be generally rectilinear, and the forward or leading side of the mounting body as a whole may comprise two planar zones, one adjacent each end. The two zones may be coplanar, or may be disposed at an appropriate angle. In either case, advantages are achieved.

Where the two zones of the leading side of the mounting body are coplanar, the need to specially machine a mounting flat for the carrier of the cutting formation is eliminated altogether. Even if a special flat is machined to form an outer mounting zone at an angle to the inner zone, it is not necessary that the mounting body be appreciably wider than the flat, and thus not appreciably wider than the carrier to be received thereon. Furthermore, such flat will intersect the inner planar zone generally in a straight line, rather than in a bothersome elliptical line such as was found in the prior art.

Accordingly, a principal object of the present invention is to provide a cutter device for a drag-type drill bit with a mounting body having a stud portion of unique and salient cross-sectional configuration.

Another object of the present invention is to provide such a device which makes optimum use of the available forward-to-rear transverse dimension simultaneously with maximization of the number of such devices which may be placed in a row on the bit body, and without undue thinness or weakness of the bit body material therebetween.

Still another object of the present invention is to provide such a device which may be self-indexing in a mating pocket in the bit body thereby eliminating the need for keyways or similar concavities.

A further object of the present invention is to provide such a device which is stronger than a device having a circular cross section of the same maximum width.

Still another object of the present invention is to provide such device whose leading side has two planar zones, one adjacent each end, wherein the maximum lateral dimension of such leading side may be generally as large as the maximum width of the mounting body as a whole.

Yet another object of the present invention is to provide an improved drag-type drill bit including such devices.

Still other objects, features and advantages of the present invention will be made apparent by the following detailed description, the drawings and the claims.

BRIEF DESCRIPTION OF THE DRAWINGS

FIG. 4 is a view similar to that of FIG. 2 showing a second embodiment of the present invention.

FIG. 5 is a front view of the embodiment of FIG. 4 taken along the line 5—5 thereof.

FIG. 6 is a transverse cross-sectional view through the stud portion of the embodiment of FIG. 4 taken along the line 6—6 thereof.

FIG. 7 is a view similar to those of FIGS. 2 and 4 showing a third embodiment of the present invention.

FIG. 8 is a front view of the embodiment of FIG. 7 taken along the line 8—8 thereof.

DETAILED DESCRIPTION

Figure 1:
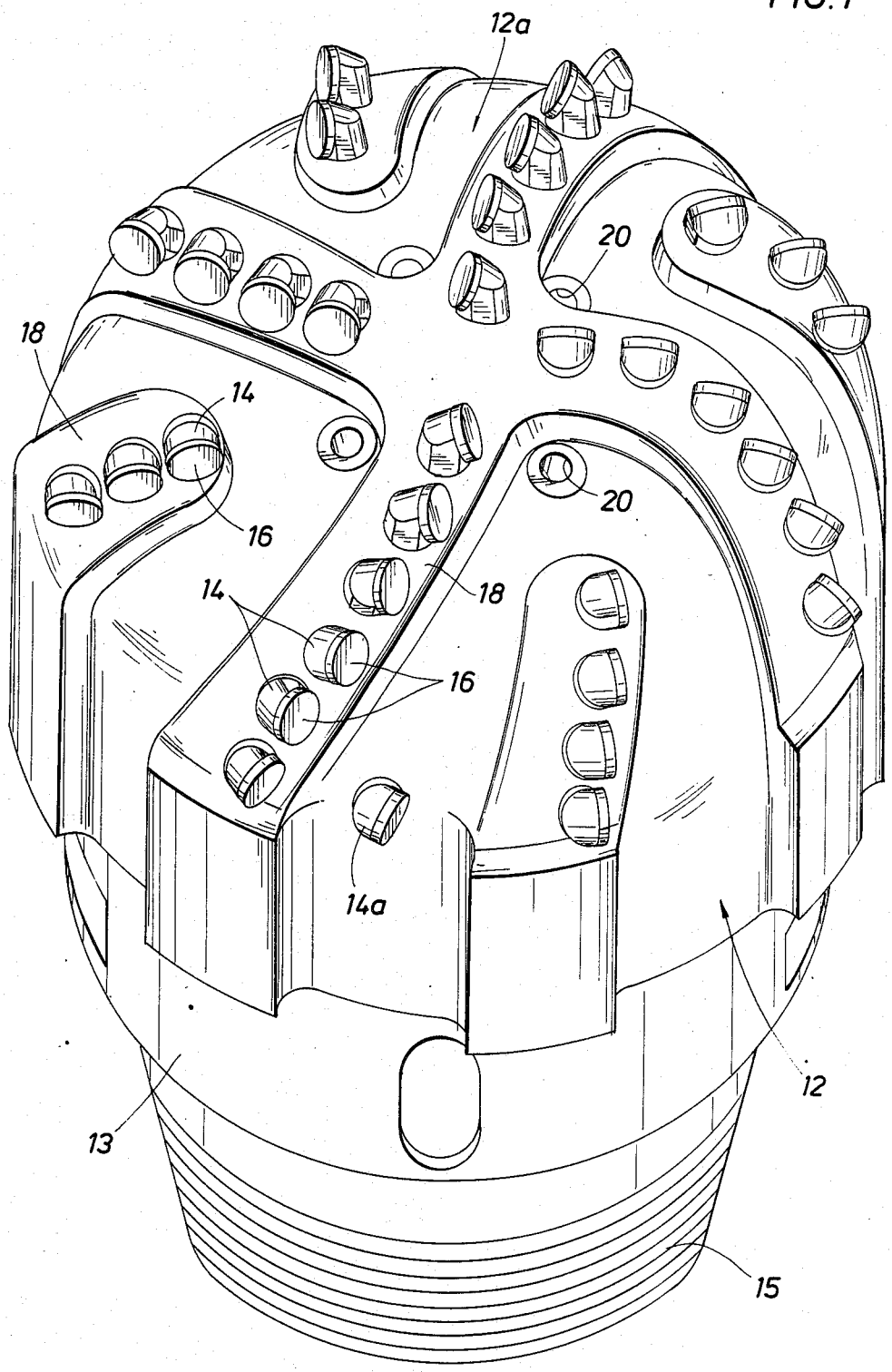
FIG. 1 is a perspective view of a drill bit.

FIG. 1 shows a representative drill bit according to the present invention. The exemplary bit shown is a full bore, drag-type drill bit. However, the present invention may also be applied to corehead type bits.

The bit comprises a bit body member 12 comprised of a tungsten carbide matrix material. Bit body member 12 is termed the "crown" of the total bit body and includes, generally at one end, a working or operating face 12*a*, and at the other end, a threaded connection (not shown) whereby the other piece of the bit body, known as the "shank" 13 can be connected to the crown 12. As is well known in the art, the shank portion of the bit body, which may be threaded then welded to the crown 12, includes a threaded pin 15 whereby the finished bit can be connected to drill pipe. For convenience, FIG. 1 illustrates the bit with the working face 12*a* uppermost, but as is well known in the art, the orientation would be reversed in use.

The bit further includes a plurality of cutter devices or assemblies 14 mounted on the bit body, and more specifically on the working face 12*a* of the crown 12. Each of the devices 14 includes a cutting face 16 which extends outwardly from the working face 12*a* of the bit crown 12. Each device 14 is oriented with respect to the bit body so that it will tend to scrape into the earth formation in use as the bit is rotated in its intended direction. Thus, the cutting faces 16 may be said to be located on the forward or leading sides of their respective devices 14, and the opposite sides of those devices may be considered the trailing sides. Most of the cutter devices 14 are arranged in rows along upset areas, blades, or ribs 18 of the working face 12*a* of the bit body member 12. However, some of the cutter devices, which may be termed "gauge cutters," and which are denoted by the numeral 14*a*, are mounted in inset portions of working face 12*a*. A number of circulation ports 20 open through working face 12*a*, near the center thereof. Drilling fluid is circulated through these ports in use, to wash and cool the working end of the bit and the devices 14.

Figure 2:
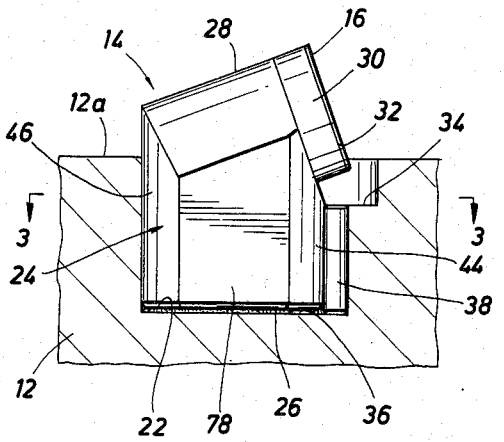
FIG. 2 is a detailed longitudinal view, partly in section and partly in elevation, showing a single cutter device and an adjacent portion of the bit body of FIG. 1.

Each of the devices 14 has a stud portion which is brazed into a respective recess or pocket in the bit body member 12. Referring to FIG. 2, there is shown a cutter device 14 which has been brazed into a pocket 22 in bit body 12. The cutter device or assembly 14 comprises a mounting body or post 24. The portion of post 24 which is to be brazed into pocket 22 will be referred to herein as the "stud portion" of post 24. This stud portion defines one end 26 of the post 24 and of the device 14 generally, specifically that end which is disposed innermost in pocket 22.

The other end, 28 of post 24 and device 14 generally, protrudes outwardly from the bit body member 12. Adjacent end 28, and on the leading side of post 24, there is bonded a carrier member in the form of a disc 30 of sintered tungsten carbide. On the leading side of disc 30 there is applied a layer 32 of superhard cutting material, comprised of polycrystalline diamond, which defines the cutting face 16 of the device. Pocket 22 has a shallow cavity 34 on its leading side for receipt of the inner part of disc 30 and layer 32.

The stud portions of the cutter devices can be fixed in their respective pockets in the bit crown in a number of different ways. Due to the intricacies of their cross-sectional configurations, cutter devices according to the present invention are particularly well suited for mounting on bit bodies formed of tungsten carbide matrix material, since such bit bodies, including the cutter receiving pockets thereof, are most conveniently formed by powder metallurgy techniques, rather than by machining, for example. Thus, in some instances, it might be possible to actually form the bit crown about the stud portions of the various cutter devices utilizing such powder metallurgy. Alternatively, the bit crown could be preformed, utilizing suitably shaped plugs to form pockets shaped for the cutter studs, the latter being subsequently fixed in their respective pockets, e.g. by brazing. Such improved configurations would similarly be well suited for use with bit bodies formed by casting.

Figure 3:
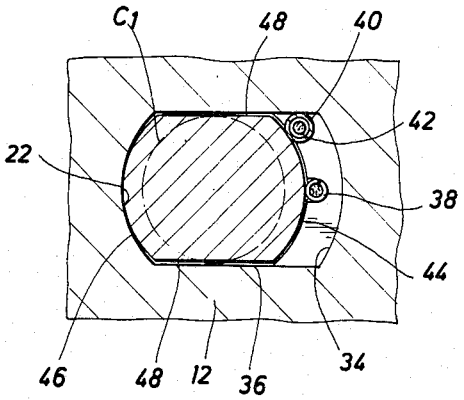
FIG. 3 is a transverse cross-sectional view taken along the line 3—3 in FIG. 2.

The device 14 of FIGS. 2 and 3 is shown as having its stud portion fixed in pocket 22 by braze material 36. More particularly, it may be assumed that the brazing has been performed according to the method described in parent application Ser. No. 575,556, and to the extent that it may be helpful to understanding the present invention, said prior application is hereby expressly incorporated herein by reference.

Briefly, during the brazing process, the mounting body 24 would have been biased toward the rear or trailing side of pocket 22 by roll pin 38, which can simply remain in place in the finished bit. The numeral 40 indicates the remnant of a tube through which braze material was directed into pocket or recess 22, and the portion of this tube protruding from recess 22 would have been cut off after completion of the brazing process. Also remaining in place in the finished bit is a roll pin 42 which would have been emplaced within tube 40 to prevent it collapsing during the manufacturing process. Small recesses for the roll pin 38 and tube 40, intersecting the main recess 22, would have been present in the pre-formed bit crown, and during the brazing process, braze material may have filled the interiors of the roll pins and tube as well as any gaps between those members and the adjacent surfaces of the bit crown, as shown.

In making the mounting body or post 24 for the device 14, a workpiece body is formed with a cylindrical stud portion adjacent one end. The other end is formed in a more or less conventional manner to receive and support the carrier member 30. Subsequently, the cylindrical stud portion of the workpiece body is machined on two diametrically opposed sides to reduce the transverse dimension of the stud portion therebetween. More specifically, the cylindrical stud portion of the workpiece body is machined with two diametrically opposed flats to form the stud portion of the finished mounting body or post 24.

The resulting finished structure comprises two diametrically opposed concentric arcs 44 and 46, convex outwardly, and a pair of diametrically opposed rectilinear connector sections 48 interconnecting arcs 44 and 46, as the device is viewed in cross section. Sections 78, as shown, are flat. Alternatively, they could be slightly convex or concave, e.g. due to the shape of the machining tool and/or other factors, but if arcuate, they should have greater radii than arcs 44 and 46. Arc 44 is coincident with what will be termed the "forward" or "leading" side of the post 24. Arc 46 defines the rear or trailing side, and flats or connector sections 48 define the "lateral" sides.

The radius of arcs 44 and 46 is chosen so as to give the maximum transverse dimension in the forward-to-rear direction, i.e. between arcs 44 and 46, which is considered practicable for the given bit design. This maximizes the strength of the post 24 in the crucial forward-to-rear direction. Then, by reducing the transverse dimension between the lateral sides of the post 24, it becomes possible to place the devices in a given row on the bit body closer together and/or to include more cutter devices in such a row. The flat configuration of lateral sides 48 is especially salient in eliminating thin, weak spots in the material of the bit body between adjacent cutters while still allowing a relatively large number of cutters per row.

The provision of the flats 48 further provides a means whereby the stud portion defined by the post 24 may be properly indexed or positioned in the pocket 22, without the need for a keyway (as used with the prior art cylindrical studs), which could further weaken the post 24. Instead, it is merely necessary to form the pocket 22 with a matching cross-sectional configuration, comprised of forward and rear opposed arcs and lateral opposed flats.

It is particularly noted that it is relatively easy and inexpensive to form the preliminary workpiece body, of which post 24 is subsequently formed, with a cylindrical stud portion, by conventional techniques such as powder metallurgy molding, to fairly close dimensional tolerances. It is then likewise a fairly simple matter to machine the flats 48, likewise to fairly close tolerances.

It is also noted that other variations are possible. For example, the radius of the original cylindrical workpiece stud portion could be made even larger than that corresponding to the maximum forward-to-rear dimension considered practical for the particular bit design, and flats could be machined on the forward and/or rear side of the workpiece stud portion, in addition to the lateral sides. In other variations, a single flat, e.g. on one lateral side, may be used. In any event, by beginning with a cylindrical workpiece stud portion, and then machining, close tolerances can be achieved relatively easily and cheaply.

In one sense, it may be said that the use of a post of the form of post 24 allows closer spacing, and more cutters per rib or blade, than would be possible with cutter devices having cylindrical stud sections of the same radius as arcs 44 and 46.

In another sense, however, it may be said that the use of the form of post 24 allows that post to be made stronger than a post having a cylindrical stud section and the same maximum width. Thus, the present invention would permit the same number of cutter devices to be placed on a given bit rib or blade as would be possible with the last-mentioned size cylindrical-stud cutters, but with improved strength. A reference circle C1 whose diameter is the same as the width of the stud portion of post 24 is shown in phantom in FIG. 3. Clearly, if lateral spacing, as opposed to fore-to-aft spacing, is critical, it would be possible to place on a give bit blade the same number of posts of form 24 as cylindrical posts corresponding in diameter to circle C1, but the former would be much stronger, particularly in the fore-to-aft direction in which the drilling forces are exerted.

The post cross section illustrated in FIG. 3 is only one of many examples of stud cross sections whereby strength can be improved, as compared to a stud having a circular section of the same maximum width. Another such example, alluded to above, is a form which might be generated, for example, beginning with a cylindrical workpiece and machining flats not only on the lateral sides but also on the forward and rear sides, resulting in a rectangular cross section. An embodiment utilizing such a cross section is illustrated in FIGS. 4–6.

The device of FIGS. 4–6 includes a mounting body or post 50 having a stud portion **50*a* adjacent to and defining one end 50*c* thereof, the stud portion 50*a* comprising at least that portion of mounting body 50 which is disposed in the recess 52 in the bit body 12'. The other end 50*b* of mounting body 50 protrudes outwardly from bit body 12'. Carrier disc 54 is bonded to the leading side of the exposed portion of mounting body 50 adjacent outer end 50*b*, and polycrystalline diamond layer 56 is carried on the outer side of carrier disc 54**.

As shown in FIG. 6, stud portion **50*a* has a rectangular cross section, and this cross section is constant throughout the entire length of stud portion 50*a*. For purposes of the present specification, small variations such as chamfered or rounded corners will not be considered as deviations from a generally constant width and depth. As in the preceding embodiment, such cross secrtion renders the post 50 stronger in the fore-to-aft direction than a generally cylindrical post of the same maximum width, represented by circle C2**.

Post 50 has a further advantage over prior art posts, which are generally made from cylindrical workpieces and result in a cylindrical stud section, as well as over the post 24 of the preceding embodiment, or any other post form having a curved leading side. The leading side 58 of post 50 forms a single, continuous planar surface as indicated by the rectilinear leading edge **58*a* of the cross section shown in FIG. 6. Thus, it is not necessary to machine leading side 58 in order to provide a mounting site for the flat-faced carrier disc 54**.

If, in the particular bit design in question, no back rake for the cutting formation 56 is desired, stud portion **50*a* can be set into bit body 12' generally perpendicular to the adjacent portion of operating face 12***a*'. However, if a back rake angle is desired, stud portion 50*a* can be set in angularly, as shown, so that it is rearwardly inclined from its inner end 50*c* to its outer end 50*b*.

Nevertheless, such inclination can be avoided, while still providing a back rake angle for the cutting formation, by grinding or otherwise forming that zone of the leading side of the mounting body which lies generally adjacent the outer end so that it lies at an angle to that zone of the leading side which extends generally along the stud portion adjacent the inner end. Such expedient is illustrated in the embodiment of FIGS. 7 and 8. The cutter device shown therein comprises a mounting body 51, a carrier 55, and a cutting formation 57 which are, respectively, identical to parts 50, 54, and 56 of the embodiment of FIGS. 4–6, except that the zone 60 of the leading side of mounting body 51 which lies adjacent its inner end 51*c* and the zone 62 of the leading side which lies adjacent outer end 51*b* are not coplanar, as in the preceding embodiment, but rather are disposed at an angle to each other. Nevertheless, both are planar, and thus they intersect in a straight line 64 rather than in a bothersome elliptical line. Furthermore, due to the improved rectangular cross section, wherein the lateral dimension of the leading side 60, 62 may be generally as great as the maximum width of the mounting body 51, the latter need not be made wider than the carrier disc 55 to be mounted thereon as in the embodiment of FIGS. 1–3. As shown, the stud portion 51*a* of mounting body 51 can be set into bit body 12" generally perpendicular to the adjacent portion of the operating face 12*a*", while the angle between zones 62 and 60 inherently provides a suitable back rake angle for the cutting formation 57 lying parallel to zone 62.

A common characteristic of the embodiments thus far described, and one which contributes to the fact that they are stronger than cylindrical stud devices of like width, is that each has a stud portion having a transverse cross section such that it cannot be circumscribed by a reference circle whose diameter is equal to the maximum width of the cross section. The characteristics of these various forms of the invention, whereby they are made stronger than cylindrical-stud devices of comparable width, can be even more specifically defined by using, for convenience, parameters and functions analogous to these normally applied to beams. It is important to note that the cutter devices of the present invention are not completely susceptible to simple beam analysis, because they are not sufficiently long with respect to their width and depth. Nevertheless, it is possible to define a function of the transverse cross section of the stud portion, in an analogous manner to that in which the function "section modulus" is defined for a beam. Because the cutter device is not a simple beam, that parameter will be referred to herein as the "assumed section modulus." While the assumed section modulus will not necessarily permit precise calculations of the strength of a given section, its use forms the basis of a simplified technique for providing general guidelines for the design of stronger cutters without resort to complicated finite element analyses.

Before proceeding with an explanation of assumed section modulus, it is believed helpful, at this point, to discuss length, width, and depth of the mounting body, its stud portion and the device in general. It should be borne in mind that any one or more of these three dimensions can vary over one or both of the other two. For example, the width may vary along the depth, the depth may vary along the length, etc. Thus, reference will be made herein to "maximum" width, depth, and/or length, as well as to "average" width, depth, and/or length.

The length of the device can be measured generally from the one end of the device which is embedded in the bit (or intended to be so embedded) to the other end which is exposed and protrudes through the operating face of the bit.

Depth is measured from the leading side to the trailing side of the device transverse to, and more specifically perpendicular to, length. Thus, depth extends generally in the intended direction of motion of the device in use as the bit is rotated and transverse to the cutting face of the cutting formation. Width is the distance between lateral sides measured generally transverse to, and more specifically perpendicular to, both length and depth, and thus, is generally transverse to the intended direction of motion in use.

The discussions of all of the transverse cross sections illustrated herein, i.e. in FIGS. 3, 6 and 9–17, assume depth extends from left to right in the figure, with the forward or leading side on the right, width extends from top to bottom in the figure, and length extends perpendicular to the plane of the paper.

The assumed section modulus of a given cross section, taken in a given direction across that cross section, is defined, for purposes of this specification, as $I/y_{max}$, where I is the assumed second moment of area of the section, and $y_{max}$ is the maximum perpendicular distance, in said given direction, of the extremity or periphery of the leading part of the section from the assumed neutral axis of the section.

The assumed neutral axis is defined as a line through the section transverse to said given direction and along which $\int y\, dA=0$, where A is area and y is perpendicular distance from neutral axis in said given direction. The assumed neutral axis for the cross section of FIG. 6 for the assumed section modulus, in the direction of depth, is shown in phantom at n by way of example.

The assumed second moment of area, I, is defined as $\int y^2 dA$.

Section modulus, neutral axis and second moment of area are defined in an analogous manner for cross sections of beams, and the "assumed" terms defined above for present purposes can be calculated in precisely the same manner as the analogous beam characteristics are calculated, and which calculations are well known in the engineering arts.

In accord with the present invention, and as exemplified by the embodiments described thus far, the stud portion of the device preferably has a transverse cross section such that its assumed section modulus, taken in the direction of depth, is greater than that of a reference circle whose diameter is equal to the maximum width of the cross section.

Each of the embodiments described thus far has a maximum depth greater than the diameter of the reference circle, and thus, greater than its own maximum width. In general, to enhance the strength in the fore-to-aft direction, it is desirable that the maximum depth of the section exceed the maximum width and/or that the average depth of the section exceed the average width. In many bits, such designs can easily be utilized, since fore-to-aft spacing is not particularly crucial. However, if for any reason it is desired to reduce the maximum depth of the stud portion, it is possible to do so while still providing a section stronger than that represented by a reference circle of the same maximum width. For example, a square circumscribing the reference circle will represent a stronger section than that circle, but assuming that the cutter devices are arranged in rows on the bit body, will not effectively take up any more room, or require greater spacing, than devices whose stud sections are defined by the reference circle.

Figure 9:
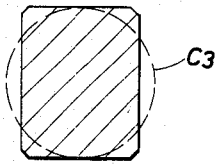
FIGS. 9—17 are transverse cross-sectional views, similar to that of FIG. 6, through stud portions of respective additional embodiments of the present invention.

FIG. 9 illustrates a rectangular cross section in which the width is equal to the diameter of the reference circle C3, but the depth is even less than that of the circle. Even this rectangular section is stronger than that represented by the reference circle C3, and could be used if it were desired to minimize the depth. The section is still such that it cannot be circumscribed by the circle C3, and in addition, the assumed section modulus in the direction of depth is greater than that of the circle C3.

Figure 10:
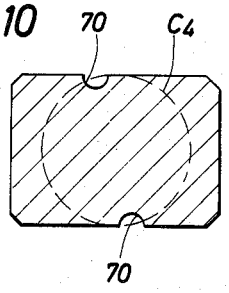

FIG. 10 illustrates another possible stud cross section which, while generally rectangular, has small concavities in the form of grooves 70 and 72 in the opposite lateral sides. These grooves are offset from one another along the depth of the section. Such grooves might be provided, for example, to hold roll pins for properly positioning the stud as it is being brazed into a pocket in a bit body. Even with these concavities, the section of FIG. 10 will be stronger than that of a reference circle C4 having the same maximum width.

Each of the cross sections thus far described in symmetrical about a central line lying along its depth. More specifically, each of the cross sections illustrated in FIGS. 6, 9 and 10 has a rectilinear leading edge which lies precisely parallel to its width and perpendicular to its depth. Thus, assuming that the leading sides of the respective mounting bodies as a whole are parallel to the leading edges shown in the cross sections, as is the case in the fully illustrated embodiments of FIGS. 4–6 and FIGS. 7–8, these devices will not have any inherent or built-in side rake angle. If they are mounted on the bit body so that their widths lie radially with respect to the bit as a whole, their leading sides, and thus the cutting formations carried thereby, will not have any side rake angle.

However, such symmetrical devices can be mounted on the bit body in such a way as to impart a side rake angle by simply rotating each mounting body about its own centerline until its leading side lies at a desired angle to a truly radial plane. However, where the cross sections, or at least the forward portions thereof, define rectangles as shown in FIGS. 6, 9 and 10, for example, when the mounting bodies are so positioned to impart side rake, certain corners will tend to directly contact the earth formation. This may be viewed as a sort of "self-correctng" problem in that the corners so interfering with the earth formation will be worn away relatively quickly, as compared with the polycrystalline diamond cutting formation, until the configuration of the mounting body has been tailored to fit the earth profile being cut. Nevertheless, this can be avoided by modifying the configuration of the mounting body so that it has an inherent or built-in side rake, and one such modification is illustrated in FIG. 11.

Figure 11:
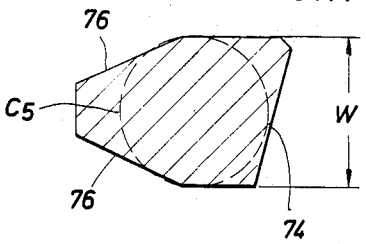

In the cross-sectional configuration illustrated in FIG. 11, the leading edge 74 is disposed angularly with respect to both the width and depth of the cross section. Edge 74 is defined by the leading side of the mounting body, and it should be understood that the entire leading side, including the outermost zone on which the carrier disc for the cutting formation would be bonded, would lie at such an angle with respect to the depth and width of the device as a whole. Accordingly, the device has an inherent or "built-in" side rake. That is to say, if the device is mounted in a bit body so that its width is arranged radially with respect to the bit as a whole, the leading side including edge 74 will be disposed at an angle to a true radial direction, and thus will impart a side rake to the cutting formation carried thereon. It can also be appreciated that this will remain true even if that leading side is machined, as in the embodiments of FIGS. 7 and 8, to further impart a built-in back rake as long as the leading side is everywhere parallel to edge 74.

It is also helpful to note that with the leading side denoted by edge 74 disposed angularly with respect to the width of the device of FIG. 11, the lateral dimension across edge 74, i.e. the distance between its extremities 74*a* and 74*b* is still generally as large as, and indeed may be slightly greater than the maximum width w of the mounting body. Thus, the embodiment of FIG. 11 can mount a carrier disc whose diameter is generally as large as the width w.

The cross section of FIG. 11 further differs from the foregoing generally rectangular cross sections in that, beginning at a point approximately mid-way along the depth of the device, and proceeding rearwardly, the opposite lateral sides are tapered toward each other as indicated at 76. This results in a reduction of the width of the device along its rearmost portion, which may be desired to prevent adjacent cutter devices from interfering with each other, or with a proper amount of bit body material therebetween, depending upon the specific bit design and the positions of the particular cutters on the bit body. For example, such a cross section of reduced rearward width might be desirable, in some bit designs, for those cutter devices which lie toward the center of the bit body.

Nevertheless, as shown in FIG. 11, the cross section is such that it cannot be circumscribed by the reference circle C5 whose diameter is equal to the maximum width of the cross section. Furthermore, it can be shown that the assumed section modulus of the cross section shown in FIG. 11, taken in the direction of depth, is greater than that for the circle C5. Thus, the cross section of FIG. 11 would result in a stronger stud than the largest cylindrical stud which could be placed in the same lateral space.

Figure 12:
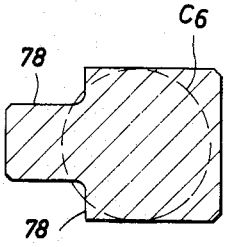

FIG. 12 illustrates another cross section which is similar to that of FIG. 11 in that the width has been reduced along the rear portion. However, rather than reducing the width by a gradual tapering as in FIG. 11, the configuration of FIG. 12 is undercut at the rear corners as indicated at 78. Again, it can be seen that the cross section cannot be circumscribed by the reference circle C6 whose diameter is equal to the maximum width of the section, and it can also be shown that the assumed section modulus of the cross section illustrated in FIG. 12, in the direction of depth, is greater than that of the circle C6.

Figure 13:
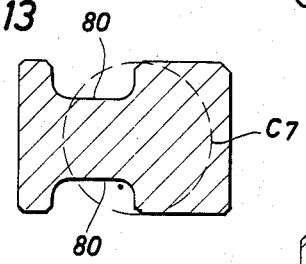

FIG. 13 illustrates still another variation on a basic rectangular section. In this case, wide grooves 80 are provided in respective lateral sides of the device, generally toward the rear, resulting in a modified T-shaped cross section. A section such as that shown in FIG. 13 might be desired, particularly for use with matrix bit bodies, and even more specifically, if the bit body is to be literally formed about the stud portions of the cutter devices by powder metallurgy techniques, since the intricacy of the cross section would provide an excellent interlocking or keying arrangement between the stud portion of the cutter device and the bit body. Of course, the section cannot be circumscribed by the circle C7 whose diameter is equal to the maximum width of the section, and the assumed section modulus, in the direction of depth, is greater than that of the circle C7.

Figure 14:
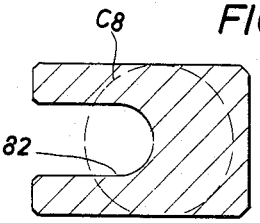
Figure 15:
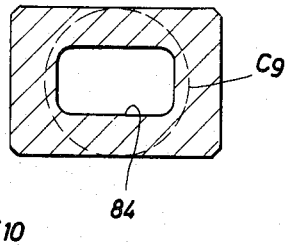
Figure 16:
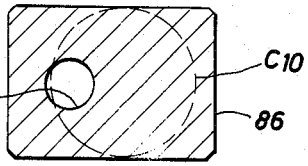

FIGS. 14–16 illustrate other variations, of relatively high strength, but which also incorporate the excellent interlocking or keying effects of the configuration of FIG. 13 when interacting with a surrounding bit body. Of course, a rectangular section of the same maximum width and depth, would be even stronger than any of these cross sections. However, because it is the material lying along the extremities of a rectangular section which most enhances its strength, whereas material nearer the center of the section contributes less, material can be eliminated from areas near the center of the section, to reduce the amount of material needed for the mounting body, and also to provide an interlocking or keying arrangement with the bit body, without unduly sacrificing strength, and in particular, while still providing a section which is stronger than a circular section of comparable maximum width. Since it is important to maximize strength in the leading portion of the device, that portion is preferably of the maximum section width and uninterrupted by substantial concavities.

Referring more specifically to FIG. 14, the section shown therein differs from a rectangular section of comparable length and width in that it has a deep groove 82 in the center of its rear portion, resulting in a modified U-shaped cross-sectional configuration. The groove 82 provides a keying or interlocking formation for mating with the bit body, and yet the section has the advantage that it is of maximum width throughout its entire depth so that full use is made of such width by providing strengthening material all along the lateral extremities of the device.

The cross section illustrated in FIG. 15 has a full rectangular exterior profile, utilizing a completely internal cavity 84, also of rectangular configuration, to reduce the total amount of material in the mounting body. The cross section of FIG. 15 would have an advantage over that of FIG. 14 in that it provides material not only all along the lateral extremities, but also completely across the front and rear extremities.

The section of FIG. 16 is somewhat similar to that of FIG. 15 except that it uses a much smaller internal cavity 85 which is circular in cross-sectional profile and which is offset rearwardly from the center of the rectangular section, leaving more material near the leading side 86 of the device, where strength is particularly crucial.

Each of the cross sections shown in FIGS. 14, 15 and 16 is stronger than a circular section of the same maximum width. It can be seen that each of these sections is such that it cannot be circumscribed by its respective reference circle C8, C9 or C10, and it can also be shown that each of these sections has an assumed section modulus, in the direction of depth, greater than that of the respective reference circle.

Figure 17:
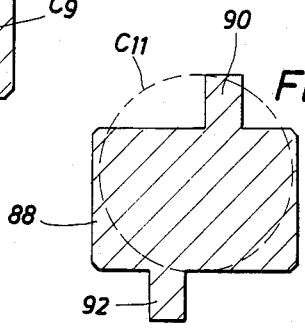

Finally, referring to FIG. 17, there is shown a cross section which may be considered as comprised of a major rectangle 88 with ears 90 and 92 projecting laterally outwardly from opposite sides, and offset from each other along the depth of the main rectangle 88. This section has at least the full strength of a rectangular section of dimensions comparable to those of main rectangle 88, together with an improved keying or interlocking configuration, provided by ears 90 and 92, but without any concavities whatsoever in the main rectangular section.

In practice, it might not be acceptable to place devices whose stud portions have the form of FIG. 17 as close together in a row as one would do with simple rectangular stud devices with dimensions comparable to those of main rectangle 88. Nevertheless, because of the offsetting of ears 90 and 92, such devices could certainly be placed much closer together than devices, whether rectangular or circular in cross section, whose maximum width is equal to the width of main rectangle 88 plus both ears 90 and 92. It would be realistic to assume, however, that such devices could be placed at least as close together as cylindrical-stud devices whose stud diameter is equal to the maximum width of the section of FIG. 17, i.e. the width of main rectangle 88 plus the dimension of one of the two ears 90 or 92. A reference circle C11 of such diameter has been shown in FIG. 17. Once again, it can be seen that the section cannot be circumscribed by the reference circle, and it can also be shown by appropriate calculations that the assumed section modulus of the section shown in FIG. 17, in the direction of depth, is greater than that of the reference circle C11. Thus, the section of FIG. 17 is stronger than a circular section of the same maximum width.

In the foregoing embodiments, the transverse cross section has been constant throughout substantially the entirety of the stud portion of the mounting body both in the respective bit body pocket and just outwardly thereof. The transverse cross section of the exposed portion of the mounting body just outside the bit body, if not identical to that of the part in the bit body pocket (e.g. due to the presence of mounting flat 62 in the embodiment of FIG. 7), then at least has the prescribed characteristics with respect to the appropriate reference circle. In less preferred embodiments, the cross section might not only vary, but might vary so that, at some points along the length of the stud portion, the section would not be stronger than that of a comparable circle. If this is done, then it is important to be sure that the mounting body at least has the desired type of cross section in the vicinity of the operating face of the bit body, especially at the leading side.

Numerous other variations of the exemplary forms of the invention described hereinabove are within the spirit of the invention. For example, the embodiment of FIGS. 1–3 has been described in the context of formation of the mounting body thereof by machining from a cylindrical workpiece. It has also been mentioned that the embodiment of FIGS. 4–6 could likewise be machined from a cylindrical workpiece. However, these embodiments, as well as other embodiments shown and described might also be formed beginning with workpieces of other configurations, and indeed, for some of the more intricate or complicated cross-sectional configurations, it might be more practical to form the entire mounting body in its finished shape by powder metallurgy techniques. It should also be apparent that numerous other mounting body forms, including many other cross-sectional configurations, are contemplated in the spirit of the invention. Accordingly, it is intended that the scope of the invention be limited only by the claims which follow.

What is claimed is:

1. An elongate cutter device for a drag-type well drilling bit, said device having a stud portion defining one end thereof and a cutting formation comprising a cutting face adjacent the other end facing outwardly in a direction of intended motion of the device in use, said device comprising a mounting body of a hard material forming said stud portion adjacent one end and carrying superhard material of said cutting formation adjacent the other end, the length of said device extending from said one end to said other end, the depth of said device extending transverse to said cutting face as well as transverse to the length, and the width of said device extending transverse to both the length and the depth, and said stud portion having a cross section transverse to the length such that said cross section cannot be circumscribed by a reference circle whose diameter is equal to the maximum width of said cross section and the maximum depth of said cross section is greater than the diameter of said reference circle, said cross section having an assumed section modulus, taken in the direction of depth, greater than that of said reference circle, and said assumed section modulus being approximately constant along more than half the length of said stud portion.

2. The device of claim 1 wherein said cross section has an assumed section modulus, taken in the direction of depth, greater than that of said reference circle.

3. The device of claim 2 wherein a substantial portion of said cross section is approximately of said maximum width.

4. The device of claim 2 wherein said cross section has forward and rear portions with reference to the intended direction of motion in use, and wherein said forward portion is approximately of said maximum width.

5. The device of claim 4 wherein said cross section is of said maximum width along at least most of its depth.

6. The device of claim 5 wherein the maximum depth of said cross section is greater than the maximum width of said cross section, and said forward portion has a rectilinear leading edge.

7. The device of claim 2 wherein said cross section has forward and rear portions with reference to the intended direction of motion in use, and wherein said forward portion has a rectilinear leading edge.

8. The device of claim 7 wherein said leading edge is disposed angularly with respect to both depth and width.

9. The device of claim 7 wherein said leading edge is disposed parallel to the width and perpendicular to such depth.

10. The device of claim 2 wherein the average depth of said cross section is greater than the average width of said cross section.

11. The device of claim 1 wherein said mounting body has a leading side with reference to the intended direction of motion in use, said leading side comprisng a first planar zone adjacent said one end and a second planar zone adjacent said other end and on which said cutting formation is carried.

12. The device of claim 11 wherein said first and second zones are angularly disposed with respect to each other and intersect in a rectilinear path.

13. The device of claim 11 wherein said first and second zones are coplanar.

14. The device of claim 11 wherein the maximum lateral dimension of said leading side is approximately as large as the maximum width of said mounting body.

15. The device of claim 14 wherein said cutting formation is mounted on said mounting body by means of an intermediate carrier.

16. The device of claim 15 wherein said mounting body and said carrier are comprised of sintered tungsten carbide, and said cutting formation comprises polycrystalline diamond.

17. An elongate cutter device for a drag-type well drilling bit, comprising:

a mounting body of a hard material having a stud portion adjacent one end and a cutting formation of superhard material mounted adjacent the other end, spaced from said one end, and facing laterally outwardly in a direction of intended motion of the device in use, the length of said mounting body extending from said one end to said other end, and the width of said mounting body extending transverse to the length as well as transverse to the intended direction of motion of said device in use, the cross-sectional configuration of said stud portion being approximately uniform along more than half its length and said mounting body further having a leading side with reference to its intended direction of motion in use, said leading side comprising a first planar zone adjacent said one end and a second planar zone adjacent said other end and on which said cutting formation is carried, said first and second zones being angularly disposed with respect to each other, and wherein the maximum lateral dimension of said leading side is approximately as large as the maximum width of said mounting body.

18. The device of claim 17 wherein said first and second zones intersect in a rectilinear path.

19. The device of claim 17 wherein said mounting body is comprised of hard material, and said cutting formation comprises a relatively thin layer of superhard material.

20. The device of claim 19 wherein said cutting formation is mounted on said mounting body by means of an intermediate carrier.

21. The device of claim 20 wherein said mounting body and said carrier are comprised of sintered tungsten carbide, and said cutting formation comprises polycrystalline diamond.

* * * * *